United States Patent [19]

Dene

[11] Patent Number: 4,714,987

[45] Date of Patent: Dec. 22, 1987

[54] READILY ASSEMBLABLE LAMPSHADE, OR THE LIKE

[76] Inventor: Michael R. Dene, 60-Coverly Ave. N., Staten Island, N.Y. 10301

[21] Appl. No.: 21,691

[22] Filed: Mar. 4, 1987

[51] Int. Cl.[4] ..... F21V 1/06

[52] U.S. Cl. ..... 362/352; 362/358; D26/118

[58] Field of Search ..... 362/351, 352, 353–358; 493/950; D26/118

[56] References Cited

U.S. PATENT DOCUMENTS

| | | | |
|---|---|---|---|
| 59,566 | 11/1866 | Dunlap | 362/352 |
| 425,735 | 4/1890 | Boesen . | |
| 1,929,315 | 10/1933 | Johnson et al. . | |
| 1,940,672 | 12/1933 | Angeletti . | |
| 2,173,547 | 9/1939 | Burke . | |
| 2,264,255 | 11/1941 | Burke . | |
| 2,404,162 | 7/1946 | Brown . | |
| 2,463,114 | 3/1949 | Klint . | |
| 2,714,155 | 7/1955 | Johnson . | |
| 4,605,996 | 8/1986 | Payne . | |
| 4,625,268 | 11/1986 | Payne . | |

*Primary Examiner*—E. Rollins Cross

*Attorney, Agent, or Firm*—Ostrolenk, Faber, Gerb & Soffen

[57] ABSTRACT

A rigidified, conical structure formed of pleated or finely fluted material, having particular application to a lampshade. It includes a lampshade body which is formed of a tube of the pleated material which is radially collapsed at one end giving the tube a frustoconical shape. An outer shell of small diameter fits around the exterior surface of the collapsed end of the lampshade body, and an inner shell of larger diameter fits against the inner surface thereof. The two shells are drawn toward each other by a bolt and the lampshade body is clamped to the surface contours of the shells to become rigidified and to give the lampshade a cone angle which is determined by the shape of the shells.

13 Claims, 3 Drawing Figures

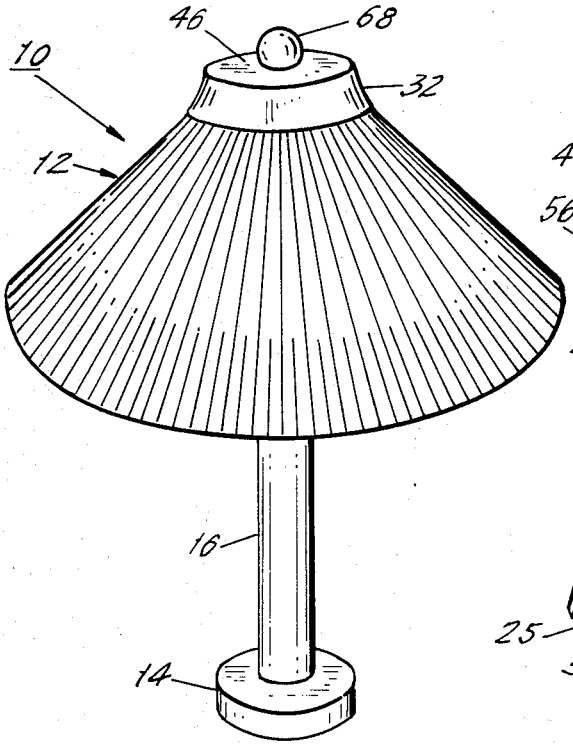
FIG. 1.
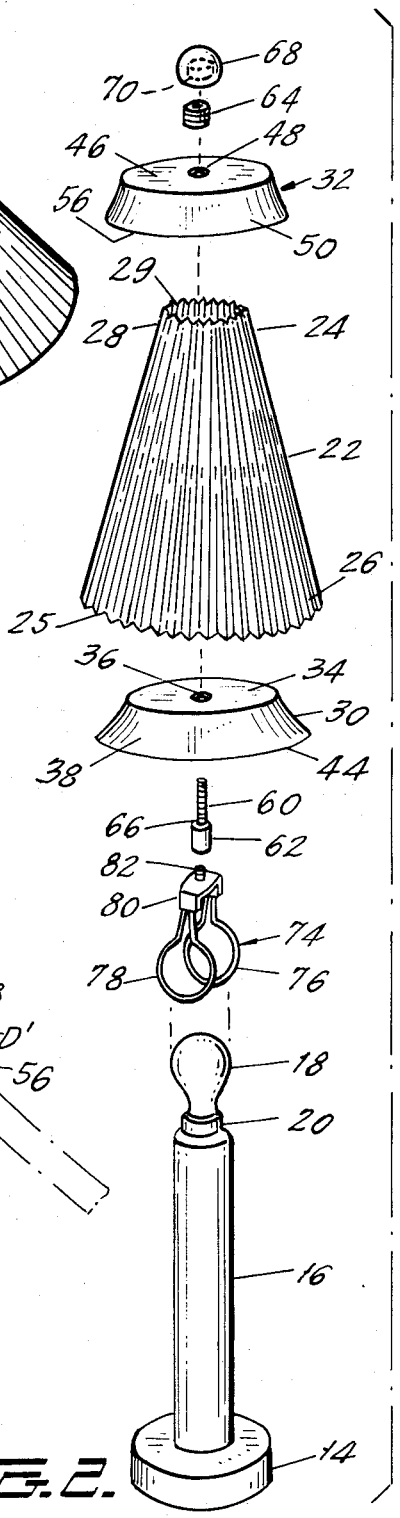
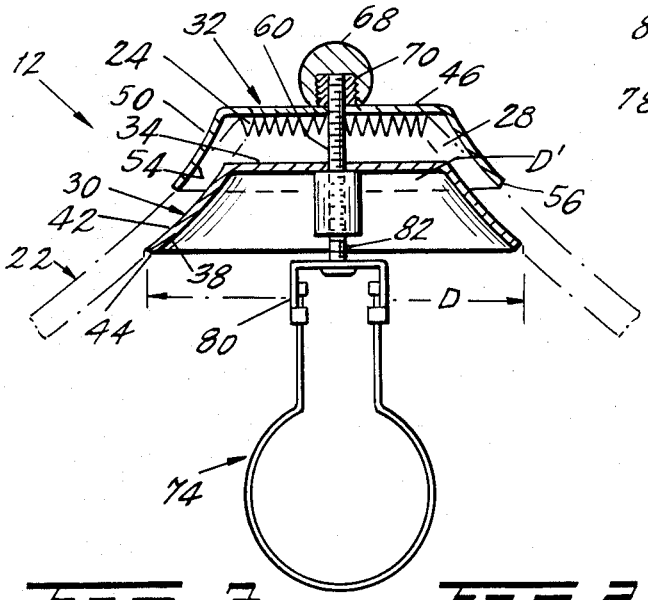
FIG. 3.
FIG. 2.

READILY ASSEMBLABLE LAMPSHADE, OR THE LIKE

BACKGROUND OF THE INVENTION

The present invention relates to a rigidified, conical structure formed of pleated, creped, folded or finely fluted material and has particular application to a lampshade. Although a lampshade is hereafter described, the invention has application to other conical structures formed of pleated material, e.g. a supporting stand, the base of the lamp, etc.

One basic style of lampshade is frustoconically shaped and formed of a finely pleated or fluted material. For stiffening the lampshade and defining its cone angle, a ring is affixed at the upper narrow end of the lampshade and an additional ring may be affixed toward the lower edge of the lampshade. The lampshade may further include ribs joining those rings.

There are extra costs for material and labor associated with the rings and ribs and their assembly. Also, once the rings have been attached to the lampshade material, the conical shape of the lampshade is precisely fixed. A manufacturer must produce a larger inventory of differently sized and shaped lampshades.

SUMMARY OF THE INVENTION

It is an object of the present invention to provide a conically-shaped object, such as a lampshade without rings normally used to shape and stiffen such object.

It is another object of the present invention to provide a suitably stiffened lampshade, or the like, constructed of initially flexible material, such as pleated or fluted paper, coated plastic or plastic coated with paper, or the like.

It is a further object of the present invention to provide a support structure for the lampshade which rigidifies the pleated lampshade and provides a connecting piece for mounting the lampshade to a lamp or the like.

Yet another object of the invention is to easily provide for variations in cone angles of a lampshade, or the like, without requiring multiple sizes of rings.

The foregoing and other objects of the present invention are realized by a lampshade, or the like, in accordance with the present invention which is formed of an initially cylindrical section of flexible, finely pleated or fluted tubular material. The tube of material is radially collapsed at one end and opened wider at the other end to give it the frustoconical shape of a lampshade.

The collapsed end of the tube is clamped between two shells, which are tightened to each other and which serve to rigidify the lampshade material and to determine its cone angle. The two shells include an inner shell whose exterior fits against the inside surface of the tube near the collapsed end and an outer shell whose interior contacts the outside surface of the tube above the inner shell. The diameter of the outside of the inner shell is greater than that of the inside of the outer shell, so that the outer shell urges the tube to expand and gives the shade its conical shape. Each shell has a center region and a downwardly depending skirt around the center region. More specifically, the lampshade material is clamped between the skirts of the shells, which are oriented and shaped such that when the shells are drawn toward each other by clamping means, e.g. by a bolt between them, the originally flexible lampshade tube is rigidified at a predetermined cone angle.

In one embodiment, the center regions of both shells are formed of a flat top with a bolt receiving hole in each top for accommodating a tightening bolt. The skirt of each shell depends downwardly from the flat top and flares outwardly. The diameter at the peripheral edge of the skirt of the inner shell is larger than the corresponding diameter of the skirt at the outer shell so that the peripheral edge of the outer shell would rest on the skirt of the inner shell if they were to lie directly atop each other. Consequently, when the clamping means draws the two shells toward one another, the peripheral edges of the two shells bite into the inner and outer surfaces of the lampshade and firmly secure it, the shade lies against the surface of at least the inner shell and the cone angle of the lampshade is established.

Other features and advantages of the present invention will become apparent from the following description of the invention which refers to the accompanying drawings.

BRIEF DESCRIPTION OF THE DRAWINGS

FIG. 1 is a perspective of a lamp having the lampshade construction according to the present invention.

FIG. 2 is an exploded perspective of the lamp of FIG. 1.

FIG. 3 is a cross-section through the upper portion of the lampshade and through the inner and outer shells which define and support it.

DESCRIPTION OF A PREFERRED EMBODIMENT

FIG. 1 illustrates a lamp 10 having a conically shaped lampshade 12 which may be assembled from parts and in the manner illustrated in FIG. 2.

Specifically, the lamp 10 is comprised of a base 14 for supporting the lamp, a lamp body 16 above the base and a lamp 18 attached to the top 20 of the lamp body 16.

A tubular lampshade body 22 of lampshade 12 is formed of an initially cylindrical tube of pleated or folded material which is radially collapsed at its upper axial end 24 and wider at its lower axial end 25 to give it its conical shape. The pleats 26 of the lampshade body 22 have widths between adjacent folds of the pleated material of between $\frac{1}{8}$ and $\frac{3}{4}$ inches. The material of the shade may be somewhat flexible, but stiffened paper, plastic or plastic coated paper, woven or nonwoven fabric, plastic or vinyl coated fabric, or the like. The cylinder constructed of the pleated material is flexible until below described shells 30 and 32 are attached to the collapsed upper end region 28 of the cylinder to form the lampshade 12. Lampshade body 22 is clamped tightly between the shells to both rigidify it and give it a selected frustoconical shape to form the lampshade, or the like.

There are an inner shell 30 and an outer shell 32. Inner shell 30 has a center region or floor 34, a post clearance hole 36 at the center of floor 34 and a peripheral outwardly flaring, downwardly depending skirt 38. As shown in FIG. 3, the outwardly flaring exterior 42 of skirt 38 is slightly concavely curved. Skirt 38 terminates at a lower peripheral edge 44 of inner shell 30 which has a diameter D as indicated.

Outer shell 32 has a center region or floor 46, post clearance hole 48 through its center and a peripheral, outwardly flaring, downwardly depending skirt 50. The outwardly flaring interior 54 of skirt 50 is convexly curved and terminates at a lower peripheral edge 56 having a diameter D' as indicated in FIG. 3. The diameter D of the inner shell peripheral edge 44 is larger than the corresponding diameter D' of the outer shell peripheral edge 56. These diameters are chosen so that were the outer shell simply placed atop the inner shell, the peripheral edge 44 of the outer shell would rest on the concavely curved exterior 42 of the skirt 38. Also, the diameters and lengths of the skirts are such that with the shells clamped together, as described below, the skirt of the outer shell extends partially over and around the skirt of the inner shell.

The shapes of the inner and outer shells are not critical, so long as in their operative parts, they are shaped to hold the lampshade and to receive the below described post 60. They need not be flat topped nor need their floors be disk-shaped. They should be circular and preferably have their above described cooperatingly curved skirt surfaces 42, 54, and both shells preferably have their flexible material biting peripheral edges 44 and 56.

The respective floors 34 and 46 of the two shells are spaced from one another to permit the upper portion 28 of the lampshade body 22 to lie in the space between the shells when the outer shell presses there- on.

The relative size, skirt shape, and spacing between the shells enables the shells to rigidify and firmly clamp the lampshade and to set the cone angle of the lampshade body 22.

To assemble lampshade 12, lampshade body 22 is lowered onto inner shell 30 such that the interior of the upper end region 28 of the lampshade body lies against the exterior 42 of the inner shell skirt 38. The outer shell 32 is positioned against the exterior of the upper end region 28, particularly at the upper edge 29 at end 24, and above the inner shell.

The two shells are held together by an externally threaded post 60 which passes through post clearance holes 36 and 48 of the two shells. A lower elongate nut 62 is partially screwed onto the lower end of post 60. A both internally and externally threaded outer nut 64 is screwed onto the top of post 60. The nuts are tightened to clamp lampshade body 22 between the shells. The ledge 66 of lower nut 62 and the outer nut 64 are, of course, larger than post holes 36 and 48. A finial 68, having internal threads 70, may be screwed onto outer nut 64 to conceal it and to add ornament to the lamp.

Since the diameter D' of the peripheral edge 56 of the outer shell is smaller than the corresponding diameter D of the inner shell, when the shells are drawn together, the peripheral edges of the two shells bite into lampshade body 22 which becomes rigidified and firmly secured between the shells and assumes a predetermined cone angle. The cone angle is determined in part by the difference in the diameters of the peripheral edges of the inner and outer shells.

Thus, the previously somewhat flexible tube is rigidified and shaped without use of rings, ribs or the like which are required in conventional lampshades constructed of pleated materials.

The assembled lampshade 12 may be secured to the lamp by a light bulb clamp 74 having a pair of resilient ring-shaped arms 76 and 78 which grip onto light bulb 18. Arms 76 and 78 are attached to one side of a base 80. A short bolt 82 on the other side of the base can be screwed into lower nut 62. A lamp harp projecting up from the base or other conventional lampshade support may be substituted.

Although the present invention has been described in relation to a specific embodiment thereof many other variations and modifications will now become apparent to those skilled in the art. It is preferred, therefore, that the present invention be limited not by the specific disclosure herein but only by the appended claims.

What is claimed is:

1. A conically shaped device, comprising:

a tubular article comprised of a tube of a flexible pleated material, the article having an exterior, an interior, opposite axial ends and an upper end region adjacent one axial end thereof;

an outer shell comprising a downwardly depending, peripheral skirt having a first inner diameter, the skirt of the outer shell being disposed over at least a portion of the exterior at the upper end region of the article;

an inner shell having a second outer diameter, which is larger than the first diameter of the skirt, the inner shell being disposed inside the tubular article toward the upper end region of the tubular article, the inner shell engaging the interior of the tubular article at a location below where the outer shell engages the exterior of the tubular article; and clamping means for drawing the outer and inner shells toward each other, and thereby for clamping the upper end region of the article between the shells, the shapes and sizes of the outer and inner shells deforming the tubular article into a conical shape.

2. The device according to claim 1, wherein the peripheral skirt of the outer shell has a first peripheral edge having the first diameter toward which the skirt downwardly depends.

3. The device of claim 2, wherein the first skirt has an interior surface which is convexly curved with respect to the tubular article.

4. The device of claim 2, wherein the inner shell has a downwardly depending and outwardly flaring second skirt, and the second skirt has a second peripheral edge having the second diameter toward which the second skirt depends; the second diameter being larger than the first diameter.

5. The device of claim 4, wherein when the clamping means draws the outer and inner shells toward each other, the first skirt of the outer shell is disposed over and around a part of the outwardly flaring second skirt.

6. The device of claim 5, wherein the first mentioned skirt of the outer shell has an interior surface which is convexly curved facing toward the tubular article; the second skirt of the inner shell has an exterior surface which is concavely curved facing toward the tubular article, whereby the tubular article is clamped between the convexly curved surface of the first skirt and the concavely curved surface of the second skirt.

7. The device according to claim 4, in which the outer shell includes a first central region that supports the first skirt and the inner shell includes a second central region that supports the second skirt; the clamping means being connected with the first and second central regions for drawing the shells together.

8. The device according to claim 7, in which the first and second central regions each comprise a plate having a respective hole therethrough for receiving a bolt therethrough, and the clamping means comprises a bolt extending through the holes in the first and second plates for connecting the first and second plates and for drawing them together.

9. The device of claim 8, wherein the clamping means comprises a threaded bolt which passes through the respective holes in the first and second plates and comprises a nut at at least one end of the bolt for being tightened on the bolt to draw the shells toward each other.

10. The device of claim 9, further comprising a finial secured on the bolt above the outer shell.

11. The device according to claim 9, further comprising a nut on the bolt below the inner shell, the nut including a threaded opening for receiving therein an additional object to be attached to the conically shaped device.

12. The device according to claim 1, in which the article is a lampshade.

13. The device of claim 1, wherein the tubular article is comprised of a material selected from the group consisting of paper, plastic, plastic coated paper, fabric, plastic coated fabric and vinyl coated fabric.

* * * * *